United States Patent [19]

Webster, Jr.

[11] Patent Number: 5,005,623

[45] Date of Patent: Apr. 9, 1991

[54] GOLF BAG RAIN COVER

[75] Inventor: James M. Webster, Jr., Baltimore, Md.

[73] Assignee: Eru, Inc., Towson, Md.

[21] Appl. No.: 475,692

[22] Filed: Feb. 6, 1990

[51] Int. Cl.[5] ..... A63B 55/00

[52] U.S. Cl. ..... 150/159; 206/315.4

[58] Field of Search ..... 206/315.3–315.5; 150/159, 160; 224/901

[56] References Cited

U.S. PATENT DOCUMENTS

| | | | |
|---|---|---|---|
| 1,119,508 | 12/1914 | Headley | 206/315.4 |
| 1,493,828 | 5/1924 | Stocks | 206/315.4 |
| 2,704,563 | 3/1955 | Henrich | 150/159 |
| 2,718,251 | 9/1955 | Barbato | 206/315.4 X |
| 2,747,637 | 5/1956 | Brown | 150/159 |
| 2,907,364 | 10/1959 | Trenery | 150/159 |
| 2,985,212 | 5/1961 | Dozier | 206/315.4 X |
| 3,059,681 | 10/1962 | Lorbeski | 150/159 |
| 3,288,189 | 11/1966 | Davis | 150/159 |
| 3,521,689 | 7/1970 | Woods, Jr. | 150/159 X |
| 3,620,276 | 11/1971 | Taylor | 150/159 |
| 3,747,171 | 7/1973 | Montague, Jr. | 224/901 X |
| 3,754,587 | 8/1973 | Rainieri | 150/159 |
| 3,913,648 | 10/1975 | Sessler | 150/160 X |
| 4,200,133 | 4/1980 | Whitlow | 150/159 |
| 4,234,025 | 11/1980 | Berge | 150/160 X |
| 4,282,912 | 8/1981 | Brown | 206/315.5 |
| 4,474,388 | 10/1984 | Wagner | 150/159 X |
| 4,667,716 | 5/1987 | Solheim et al. | 150/160 |
| 4,752,004 | 6/1988 | Very | 150/159 |

FOREIGN PATENT DOCUMENTS

| | | | |
|---|---|---|---|
| 341680 | 7/1931 | United Kingdom | 206/315.3 |
| 376766 | 7/1932 | United Kingdom | 206/315.3 |
| 1230580 | 5/1971 | United Kingdom | 206/315.3 |
| 1277431 | 6/1972 | United Kingdom | 206/315.3 |
| 2133700 | 8/1984 | United Kingdom | 150/160 |

*Primary Examiner*—Sue A. Weaver

*Attorney, Agent, or Firm*—Leonard Bloom

[57] ABSTRACT

A flexible, waterproof, lightweight compact cover for the top of a golf bag and for golf clubs having a first end and a second end. The first end is snugly secured about the top of the golf bag with fasteners. The first end has at least one slit therein which is received by a ring on the top of the bag preventing rotation of the cover circumferentially about the top of the bag. The second end of the bag extends outwardly from the bag covering the golf clubs and the top of the golf bag. The second end of the cover is folded back and fastened to the first end of the cover. To gain access to the golf club, the second end of the cover is lifted and the golfer may reach in to remove the golf club while still preventing rain from entering the top of the golf bag. The second end of the cover may be rolled downwardly to form a collar about the top of the golf bag and, when so disposed, the cover may be unrolled rapidly to protect the top of the golf bag and golf clubs from rain and inclement weather.

37 Claims, 9 Drawing Sheets

GOLF BAG RAIN COVER

FIELD OF THE INVENTION

The present invention relates to covers for golf bags to prevent rain from entering the golf bag and to permit ease of access to golf clubs within the golf bag while the rain cover is secured to the top of the bag. In particular, the present invention is concerned with a compact, flexible, lightweight, completely waterproof cover which is easily secured to the top of the golf bag.

BACKGROUND OF THE INVENTION

Covers are known for golf bags to protect the inside of the bag and the golf clubs in the bag from rain and other inclement weather.

In U.S. Pat. No. 2,718,251 issued to Barbato, there is disclosed a cover for completely enclosing a golf bag and including an end portion for enclosing the heads of golf clubs contained in the golf bag. The upper end of the cover has a zipper closure for removal of the golf clubs.

U.S. Pat. No. 2,985,212 issued to Dozier discloses a cover which is adapted to fit over and substantially envelop the entire golf bag and the golf clubs continued therein. There is a slit across the top of the bag with a flap overlapping the slit.

Another rain cover for a golf bag mounted to a pull golf cart is disclosed in U.S. Pat. No. 4,474,388 issued to Wagner. This cover extends as side portions on two opposite sides of the bag and has a top roof portion slanting across the top of the bag.

Still another rain cover is disclosed and U.S. Pat. No. 3,754,517 issued to Rainieri. The cover is a tube which preferably is of sufficient length to fully cover the golf bag. A flap over the top of the golf bag is an extension of one wall of the cover which is folded over the opposite wall and a heat seal is formed across the overlapping sheets.

U.S. Pat. No. 3,977,451 issued to Duba discloses a cover which can be used with a golf bag having a hood to cover the opening provided in the hood of bag.

Additional prior art patents known to the applicant are as follows:

| Inventor | U.S. Pat. No. |
|---|---|
| Brown | 2,747,637 |
| Davis | 3,288,189 |
| Finderson | D 238,086. |

Despite these disclosures in the prior art, there is still a need for a simple, easily installed, easy to use device to protect the top of a golf bag and the golf clubs from the rain and inclement weather.

SUMMARY OF THE INVENTION

A principal object of the present invention is to provide a cover for the top of a golf bag which is compact, lightweight, completely waterproof, easy to install and easy to use and which is effective in preventing rain and inclement weather from entering the top of the golf bag.

A further object of the present invention is to provide a cover for the top of a golf bag which is easily and rapidly secured to the top of the bag and does not rotate about the top of the bag.

Another object of the present invention is to provide a cover for the top of a golf bag wherein the golfer can access the golf clubs within the bag from a desired side of the bag while preventing rain and the like from entering the golf bag.

A still further object of the invention is to provide a cover for a golf bag which is easily secured to the top of the bag, can be rolled down about the bag like a collar to be out of the way of the golfer when it is not raining and may be unrolled for instant and effective use when it is raining.

In accordance with the teachings of the present invention, there is disclosed a rain cover for the top of a golf bag and for the golf clubs therein, the rain cover being compact, light-weight, flexible and completely waterproof. The cover includes a sleeve having a first open end, a second open end and a sidewall therebetween. The first open end has a slit therein. The slit cooperates with a ring, which is a conventional component attached near the top of the golf bag, such that the ring may be inserted through the slit and a carrying strap on the golf bag may be connected to the ring. This attachment retains the cover on the golf bag and prevents rotation of the cover about the top of the golf bag. The first open end of the cover has a releasable fastening means attached thereto. The first open end further has a strap attached thereto. The strap has thereon a fastening means which cooperates with the releasable fastening means such that when the respective fastening means are engaged, the first end of the cover may be securely snugged to conform to the top of the golf bag. When so secured, the second end of the cover is disposed outwardly from the top of the golf bag and is draped over the top of the golf bag and the golf clubs therein, the cover hanging freely therefrom. A panel opening in the side wall of the cover, extends from the second end toward the first end of the cover. When draped over the top of the golf bag, the second end may be lifted to provide ease of access to the golf clubs while providing cover to the top of the golf bag. A releasable first fastening means is attached to the second end of the cover. A cooperating second fastening means is attached to the first end of the cover near the panel opening such that when the second end of the cover is folded toward the first end of the cover over the top of the golf bag and the respective first and second fastening means are engaged, the top of the golf bag and the golf clubs therein are protected from rain. Further, when the first and second fastening means are disengaged, the second end may be lifted providing access to the golf clubs from an angle and preventing rain from entering the golf bag.

In a preferred embodiment, the cover is fabricated from a multilayer material. This material has a durable scuff resistant outer layer, a waterproof center layer and an inner layer. The fastening means are hook and loop fasteners which may be easily fastened and unfastened.

Also, in a preferred embodiment, the first end of the cover is snugged to the top of the golf bag and the cover may be rolled toward the top of the bag to form a collar about the top of the bag. The collar may be easily and rapidly unrolled to protect the top of the bag and the golf clubs from rain.

These and other objects of the present invention will become apparent from a reading of the following specification, taken in conjunction with the enclosed drawings.

DESCRIPTION OF THE PREFERRED EMBODIMENT

Figure 2:
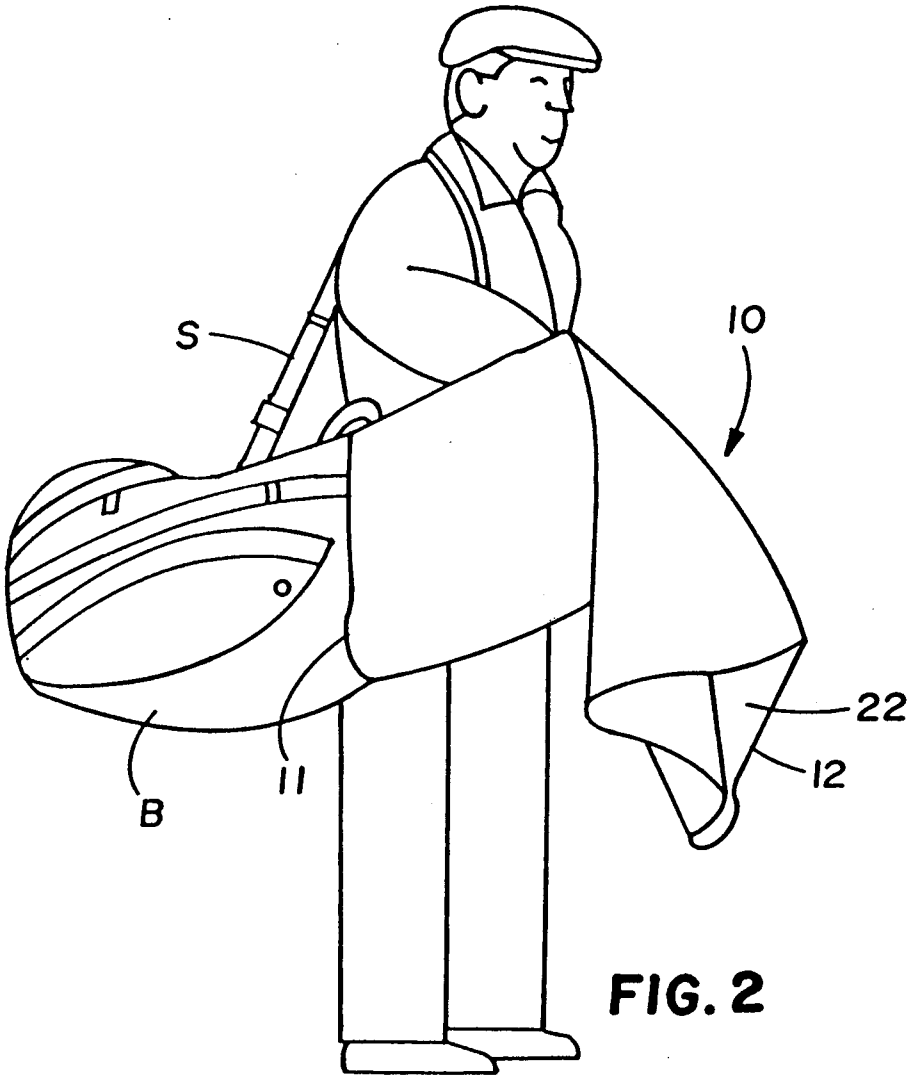
FIG. 2 is a perspective view of the present invention mounted on a conventional golf bag which is carried by a golfer.
Figure 1:
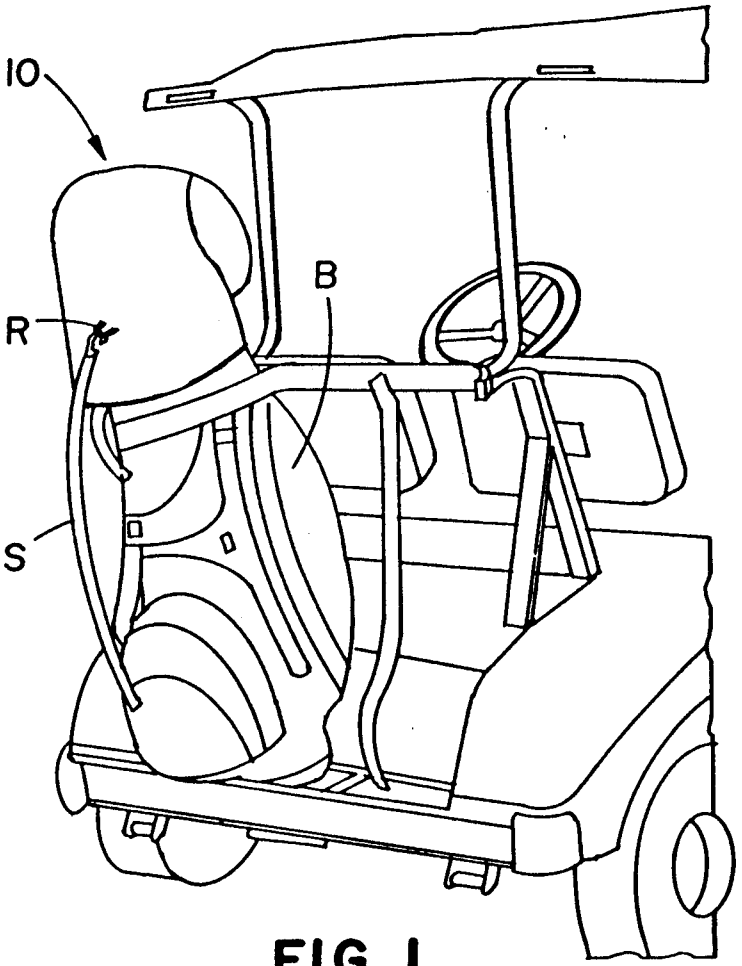
FIG. 1 is a perspective view of the present invention as it is attached to a conventional golf bag which is carried on a golf cart.
Figure 3:
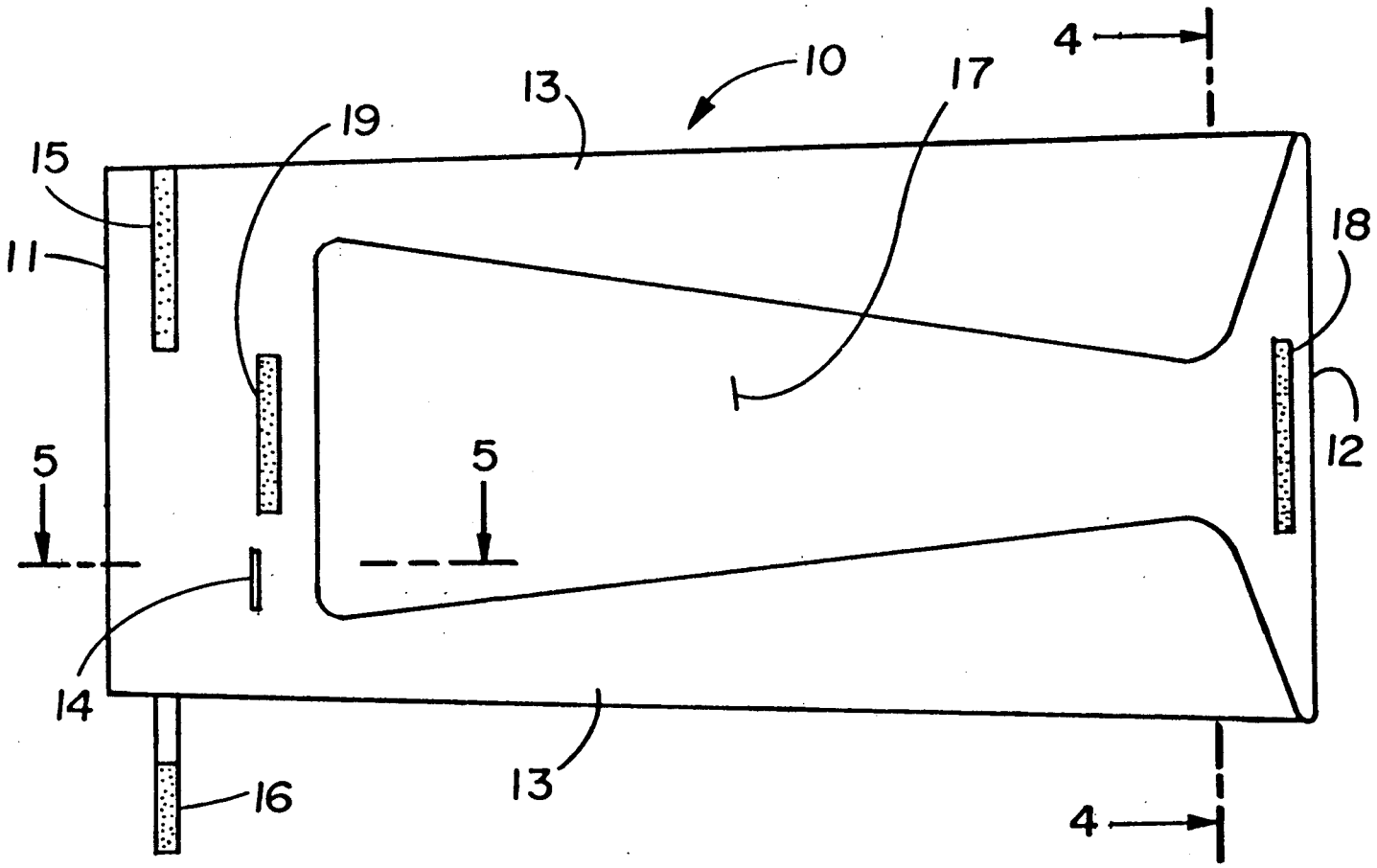
FIG. 3 is a perspective view of the present invention showing the fastening means and the panel opening.
Figure 4:
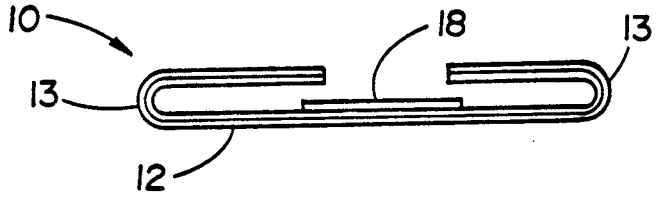
FIG. 4 is cross-section view taken along the lines 4—4 of FIG. 3.
Figure 5:
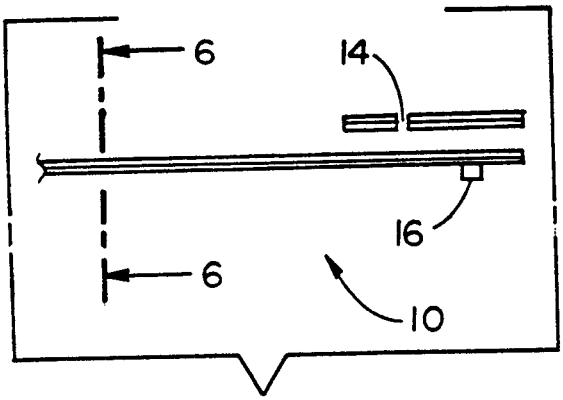
FIG. 5 is a cross-section view taken across the lines 5—5 of FIG. 3.
Figure 6:
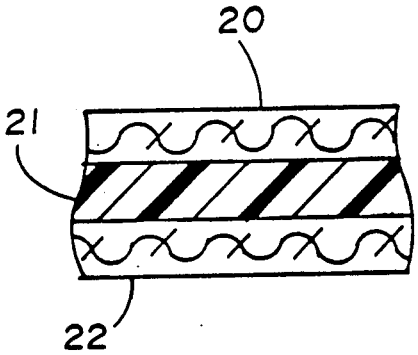
FIG. 6 is an enlarged cross-section taken across lines 6—6 of FIG. 5.

Referring now to the drawings, FIG. 1 shows the present invention attached to the top of a golf bag B as the bag is typically carried on a golf cart. FIG. 2 shows the present invention attached to the top of a golf bag and carried by a golfer. The cover 10 is attached snugly to the top of the golf bag B and hangs freely over the golf clubs C. As shown in FIG. 3, the cover 10 is a sleeve having a first open end 11, a second end 12 and a sidewall 13 therebetween. In a preferred embodiment, the first end 11 has a smaller diameter than the second end 12 of the cover 10. The cover 10 is a sleeve with a panel opening 17 which extends from the second end 12 towards the first end 11 of the cover 10. In an alternate embodiment, the cover may have continuous sidewalls 13 without having a panel opening therein. The purpose of having a panel opening will be described later. FIG. 4 shows the cover 10 as viewed toward the second end 12. The sidewalls 13 are folded toward the center with the panel opening 17 therebetween. FIG. 5 shows a cross-section at the first end 11 of the cover 10 which illustrates that the panel opening 17 does not extend to the first end 11 of the cover 10. In one embodiment, the cover 10 is fabricated from a multilayer material as shown in FIG. 6, although other embodiments are possible using a single layer of material. The outer layer 20 is a durable, scuff resistant material such as nylon which is also lightweight and flexible. The center layer 21 is a completely waterproof material such as a microporous polymeric filter of polytetrafluoroethylene. Fabric available from W. L. Gore and Assoc., Inc., Elkton, Md. sold under the registered trademark GORE-TEX has been found to be satisfactory for this purpose. Other materials, known to those skilled in the art may be used if the material is sufficiently flexible. The inner layer 22 is a fabric which may be white or reflectorized to improve visibility when the second end 12 of the cover 10 is lifted for access to the golf clubs C as will be described later.

Figure 8:
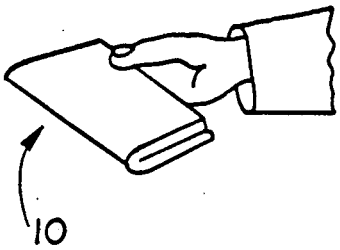
FIG. 8 is a perspective view of the present invention showing it folded into a small compact configuration.

The compact, lightweight cover 10 may be folded to a size of approximately five inches by five inches by one inch (FIG. 8) and may be easily stored in a golf bag.

Figure 7:
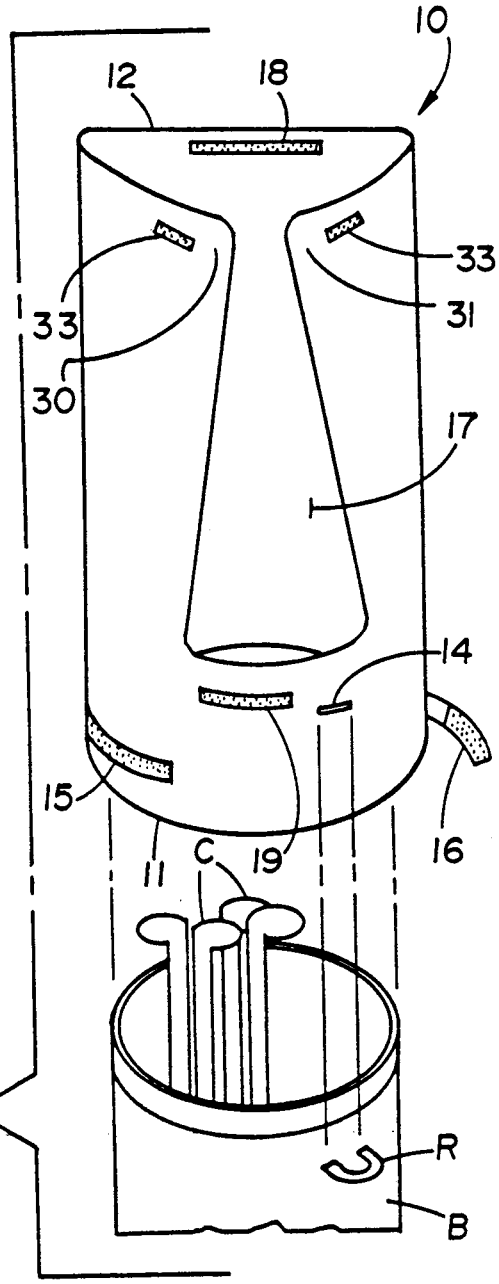
FIG. 7 is a perspective exploded view showing the present invention as it is placed on the top of a conventional golf bag.
Figure 9:
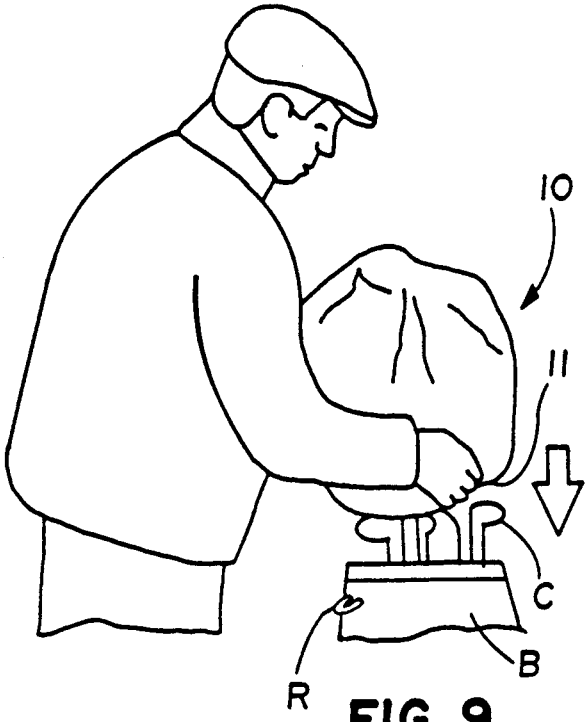
FIG. 9 is a perspective view of the present invention placed on the top of a golf bag.
Figure 10:
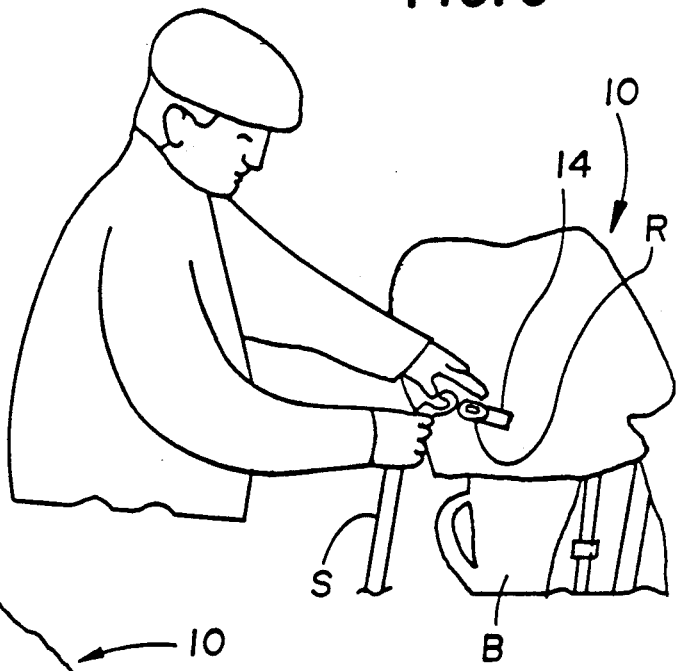
FIG. 10 is a perspective view of the present invention showing the ring on the golf bag inserted through the cover and the strap on the golf bag connected to the ring.
Figure 11:
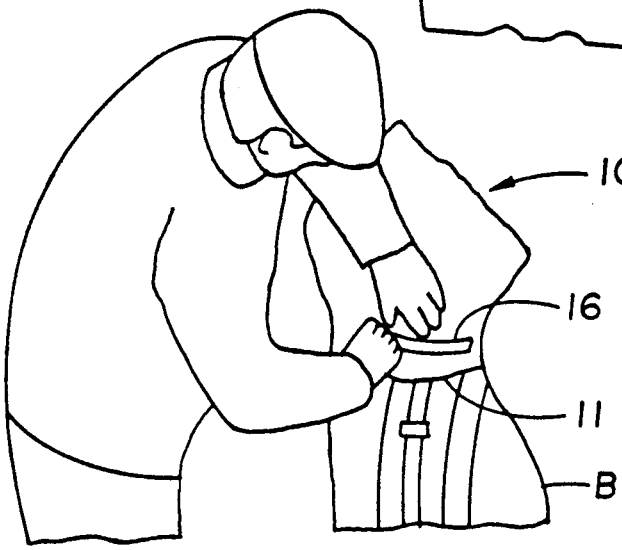
FIG. 11 is a perspective view of the present invention showing the cover being snugged about the top of the golf bag.
Figure 12:
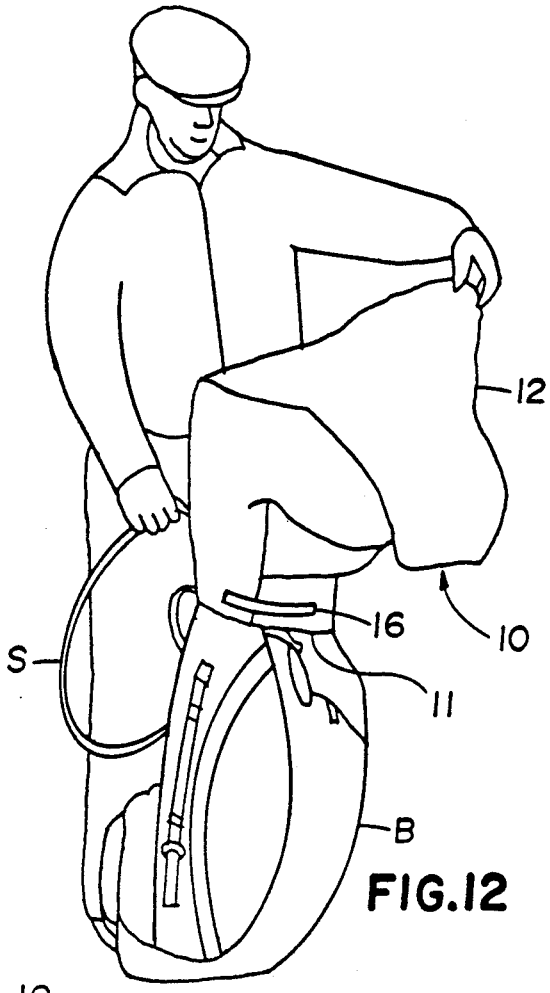
FIG. 12 is a perspective view of the present invention showing the end of the cover extending outwardly from the bag and over the golf clubs.

Referring to FIGS. 3 and 5, the cover 10 has at least one slit 14 in the first end 11 of the cover 10. When the cover 10 is placed over the top of the golf bag B (FIGS. 7 and 9), the ring R which is on the bag is received in the slit 14 (FIG. 10). The carrying strap S on the golf bag is connected to the ring R, thereby securing the cover 10 to the bag B and preventing rotation of the cover 10 about the top of the bag B. The first end 11 of the cover 10 has an adjustable fastening means 15 attached thereto. A cooperating fastening means 16 is also attached to the first end 11 of the cover 10. FIG. 3 shows fastener 15 being a strip of hook or loop fasteners and fastener 16 being a strap having hook and loop fasteners thereon. When the cover 10 is placed on the top of the golf bag B, the cover 10 is snugged about the top of the bag B, conforming to the top of the bag B and the fastener 15, 16 are connected (FIG. 11). In this manner, the cover 10 is secured to the top of the bag in a simple and rapid manner. Other fasteners, known to persons skilled in the art, could be used in place of the hook and loop fasteners. When the first end 11 of the cover 10 is attached to the bag B, the second end 12 of the cover 10 extends outwardly (FIG. 12) from the bag B with the golf clubs in the cover 10. The second end 12 drapes over the golf clubs C and hangs freely from the top of the golf clubs C completely covering the golf clubs C and the open top of the bag B (FIGS. 1 and 2). To hold the second end 12 of the cover in place, a releasable first fastening means 18 is attached to the inner layer 22 of the second end 12 of the cover 10 and a cooperating second fastening means 19 is attached to the outer layer 10 of first end 11 of the cover 10 (FIG.

3). The fastening means may be of any type known to persons skilled in the art, but hook and loop fasteners are preferred for ease of use and lightweight. When the hanging second end 12 of the cover 10 is fastened to the first end 11 of the cover 10, the golf clubs C are completely protected from rain and inclement weather. This is most useful under very windy conditions to secure cover to bag and to prevent wind driven rain from wetting the golf clubs in the golf bag.

In an alternate embodiment (FIG. 7), the second end 12 of the cover 10 has a first corner 30 and a second corner 31 formed by the panel opening 17 extending to the second end 12. Cooperating fasteners 33 attached to the first corner 30 and the second corner 31 are used to connect these corners 30, 31 to one another after wrapping the second end 12 of the cover 10 around the top of the bag B. This provides additional protection from the rain and permits the hanging ends to be neatly held to the bag.

Figure 14:
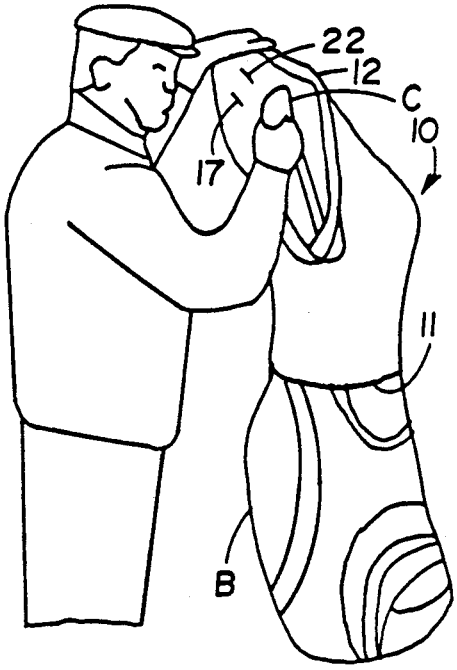
FIG. 14 is a perspective view of the present invention showing the cover lifted for removal of a golf club from the golf bag.
Figure 13:
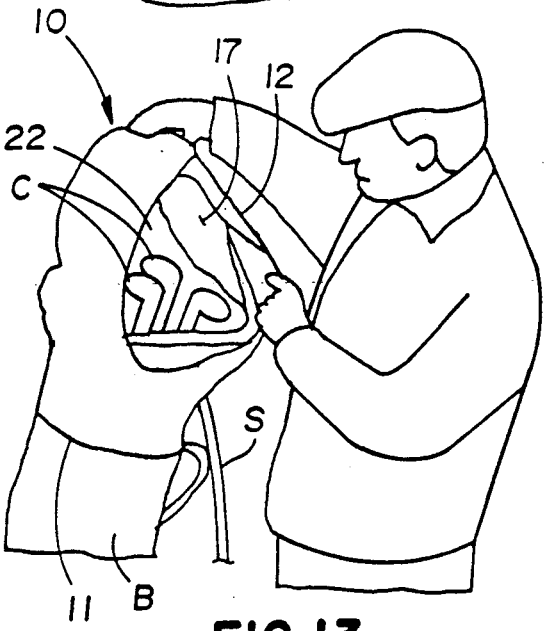
FIG. 13 is a perspective view of the present invention showing the cover lifted for access to the clubs and further showing the reflectorized inside of the cover.

To gain access to the golf clubs C, the golfer need only open the fasteners 18, 19, 20, lift the second end 12 of the cover 10 and reach into the second end 12 of the cover 10 (FIGS. 13 and 14). The embodiment which has a panel opening 17 provides easier access to the golf club C since the golfer does not have to reach down between the sidewall 13. The panel opening 17 may be rectangular, triangular, oval or of any desired configuration. The panel opening 17 provides access directly to the golf club C. The panel opening 17 allows ease of access on the side of the cover 10 on which the opening exists. When the golf bag B is carried on a golf cart where access is usually from the same side, the cover may be mounted on the bag in the desired orientation by use of cover 10 having a plurality of spaced apart slits 14 on the first end 11 of the cover 10. In this manner, the cover 10 is circumferentially disposed by inserting the ring R through the selected slit 14. This permits the open panel 17 to be on the desired side of the bag B. Also, by having the inside layers 22 of the cover 10 made of white or reflectorized material, it is easier to see the clubs inside the cover 10.

Figure 16:
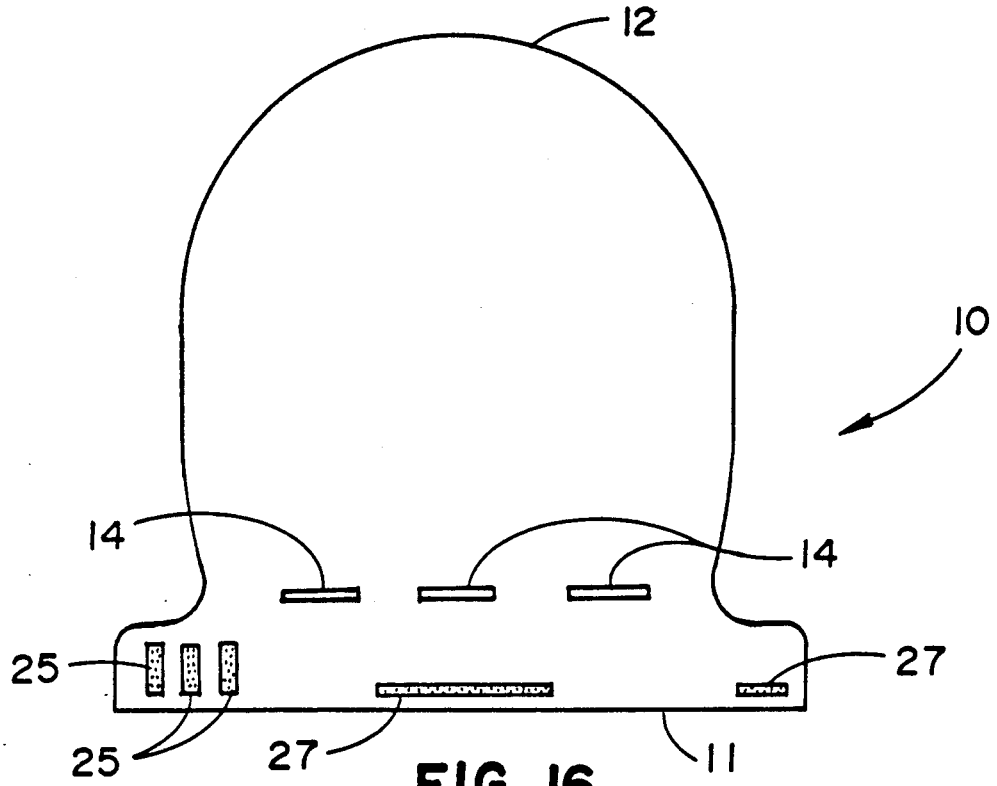
FIG. 16 is a top plan view of an alternate embodiment of the present invention.
Figure 17:
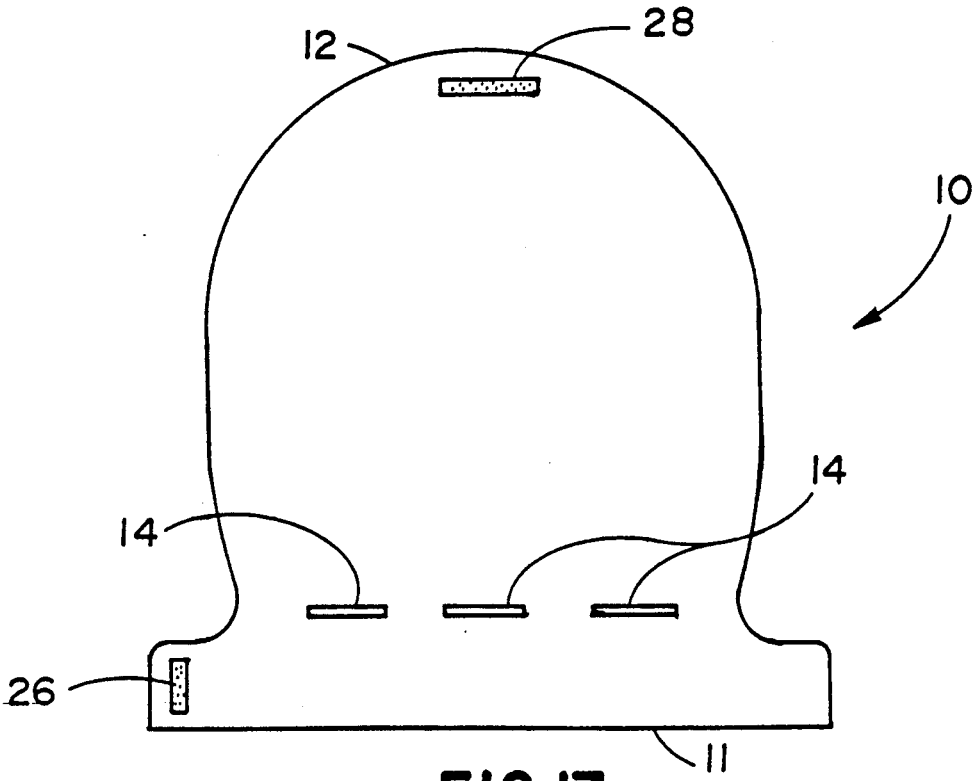
FIG. 17 is a bottom plan view of the embodiment of FIG. 16.
Figure 18A:
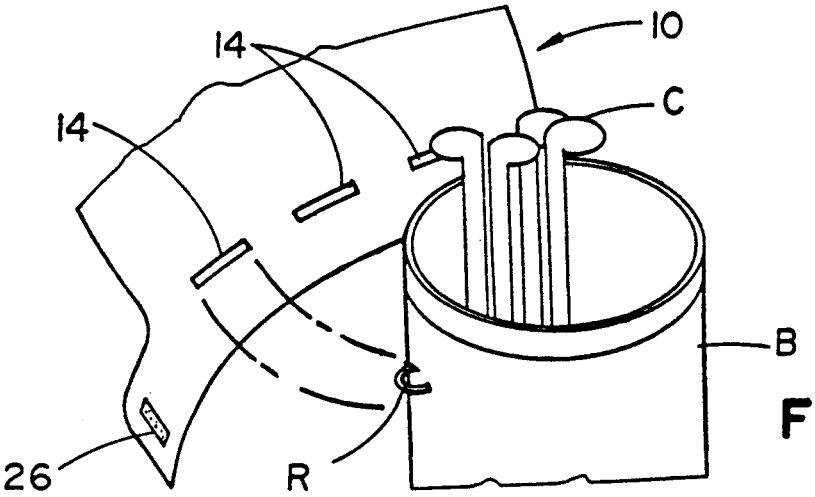
FIGS. 18A-18C are perspective views showing the insertion of the ring on the golf bag into the selected slot in the alternate embodiment of the present invention.
Figure 18B:
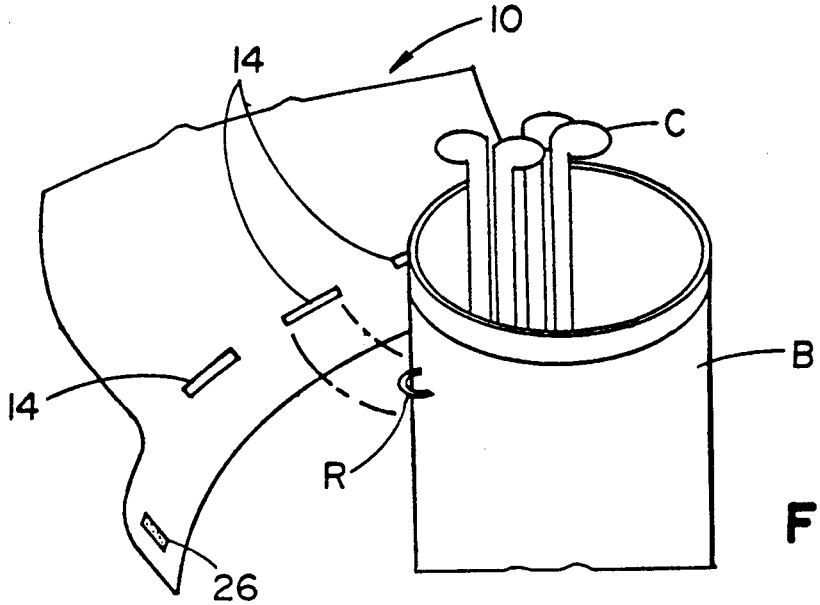
Figure 18C:
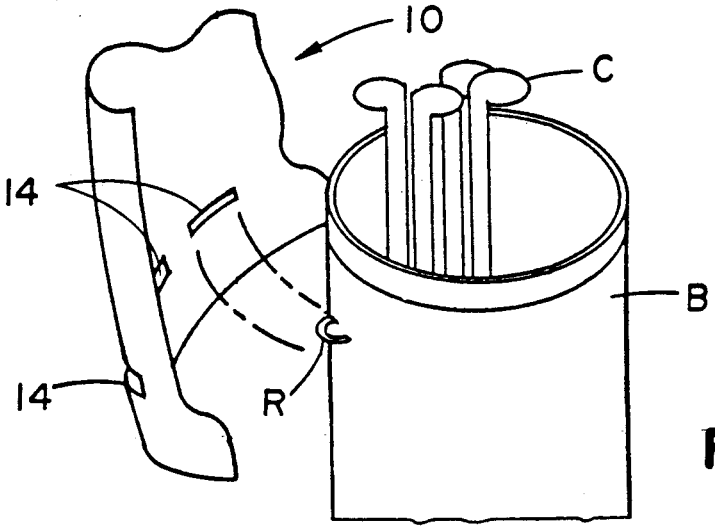
Figure 19C:
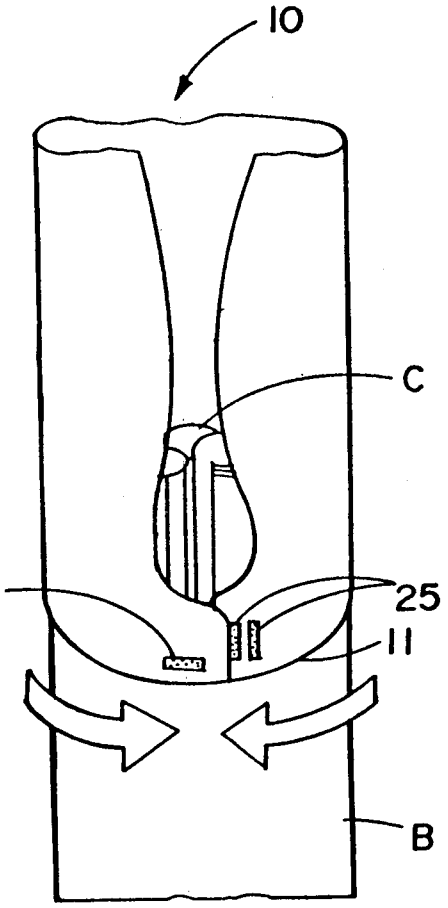
FIGS. 19A-19C are perspective views showing the sequence of attaching the alternate embodiment of the present invention to the golf bag.
Figure 19B:
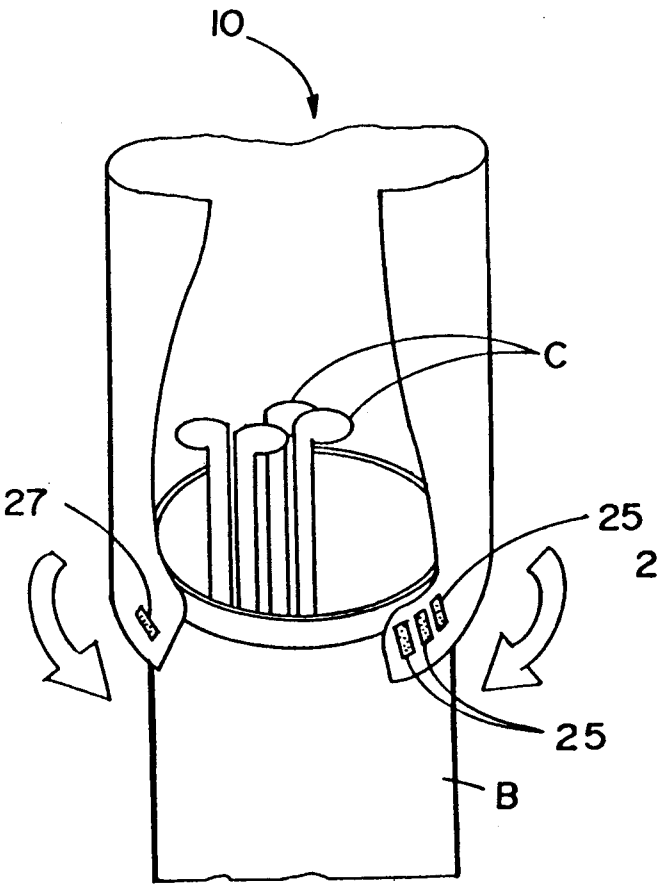
Figure 19A:
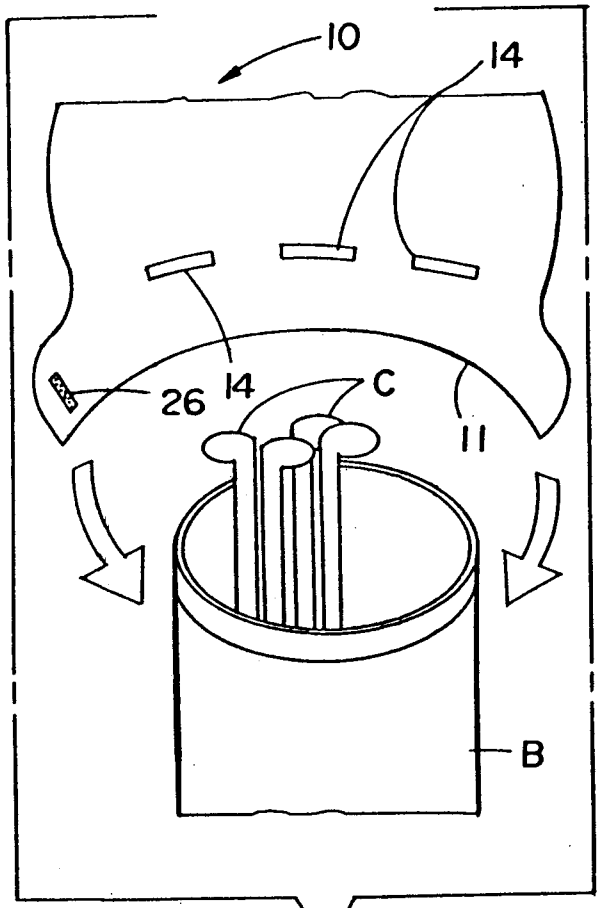

In another preferred embodiment, the cover 10 is a sheet of material having an outside (FIG. 16) and an inside (FIG. 17) and further having a first end 11 and a second end 12. This embodiment is preferably fabricated from the same multilayer material as previously described. The first end 11 has a length which is sufficient to be wrapped around the top of any conventional golf bag B. Near the first end 11, there is at least one slit 14 therein to receive the ring R which is on the golf bag. Preferably, there are three (3) spaced-apart slits 14 near the first end 11 of the cover 10 so that ring R may be inserted in a desired slit 14 and the cover may be mounted on the bag at a selected position to permit the cover to be folded over the bag in a desired direction and also to prevent rotation of the cover 10 about the top of the bag. (FIGS. 18A–18C). The preferred location of the slits 14 are: one in the center of the first end 11 and the other two slits on either side at a distance corresponding to one-quarter of the distance about the top of the golf bag. In this manner, the cover 10 may be mounted on the golf bag at a selected position which is adjustable through 90° in either direction compared to mounting using the center slit 14 (FIGS. 18A–C). This feature is especially useful when the golf bag is carried on a golf cart and the golf bag is turned for ease of access. The first end 11 also has an adjustable fastening means to secure the first end 11 about the top of the golf bag. Preferably, there are a plurality of strips of hook or loop fasteners 25 on the outer side of the first end 11 and a cooperating strip (or strips) of hook or loop fasteners 26 on the inside of the first side 11. In this manner, when the first end 11 is wrapped around the top of the golf bag B (FIGS. 19A–19C), the fastener 26 on the inside of the first end 11 may engage the selected fastener 25 on the outside of the first end 11 to adequately and snugly secure the cover 20 to the top of the bag. As is known to those skilled in the art, other configurations of the hook and loop fasteners may be used and other types of fasteners, including pressure fit snaps and buttons with button holes, may also be employed. The first end 11 of the cover 10 also has at least one further fastening means on the outside thereof to which the second end 12 may be attached after securing the first end 11 about the golf bag B. Preferably, this further fastening means is a hook or loop fastener 27. The inside of the second end 12 of the cover 10 has a further fastener(s) 28 attached thereto to cooperate with the fastener(s) 27 on the first end 11.

Figure 20:
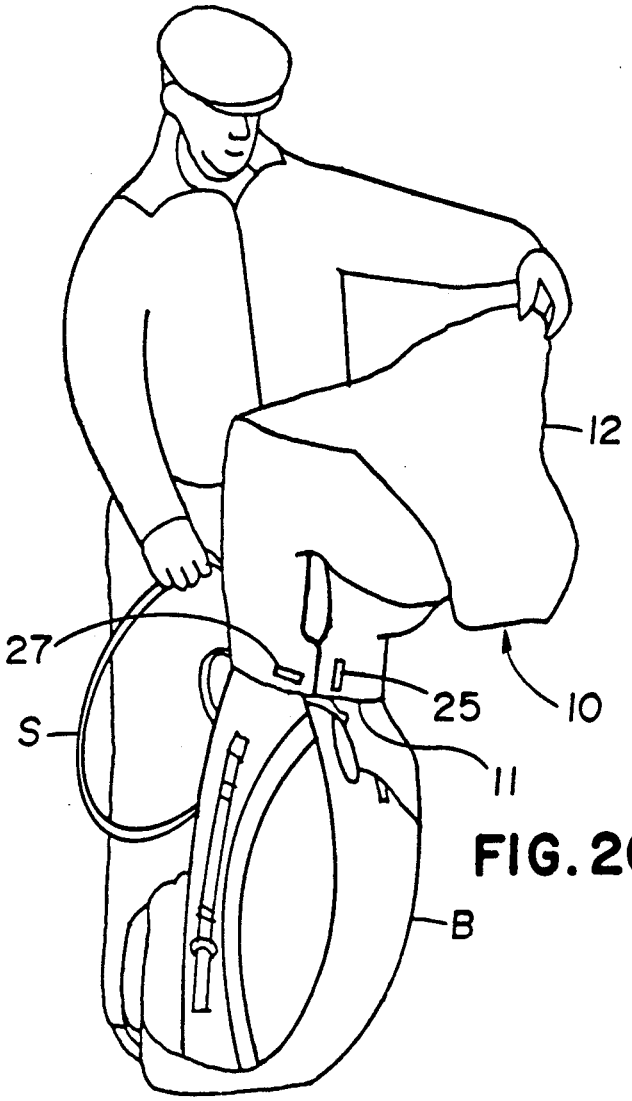
FIG. 20 is a perspective view showing the first end of the alternate embodiment of the present invention attached to the golf bag and the second end extending over the golf clubs.

As shown in FIG. 20, when the first end 11 of the cover is secured to the top of the golf bag B as described, the second end 12 extends outwardly above the golf bag B. The second end 12 of the cover 10 drapes over the golf clubs C completely covering the golf clubs C and the open top of the golf bag B. The further fastener(s) 27 on the first end 11 of the cover 10 is engaged with the further fastener(s) 28 on the second end 12 of the cover 10 to retain the cover 10 over the golf clubs C, to prevent the second end 12 of the cover from being blown about by the wind and to protect the golf clubs C and the top of the golf bag B from rain and wind-driven rain.

Figure 21:
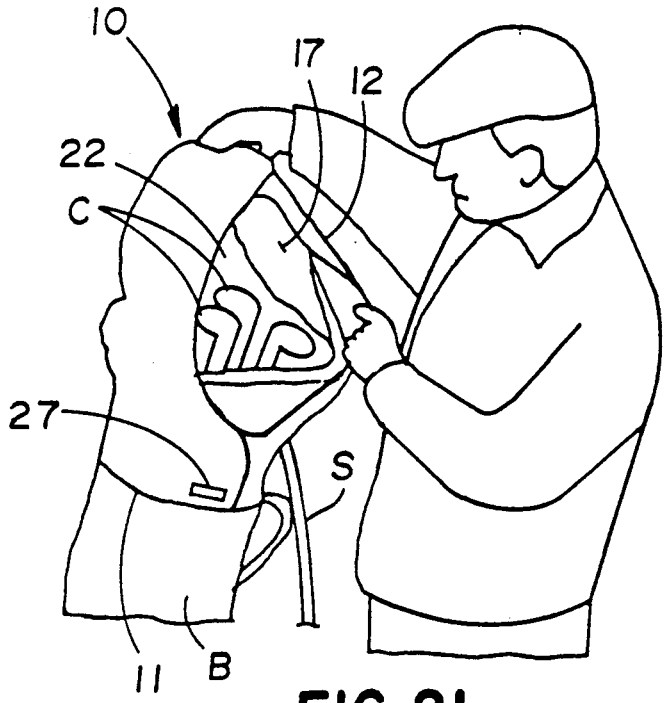
FIG. 21 is a perspective view of the golfer opening the cover of the alternate embodiment for the removal of a golf club.

To gain access to the golf clubs C (FIG. 21), the user disengages the fasteners 27, 28 on the ends 11, 12 of the cover 10 and lifts up the second end 12 of the cover 10. The golf clubs C are readily available.

Figure 15:
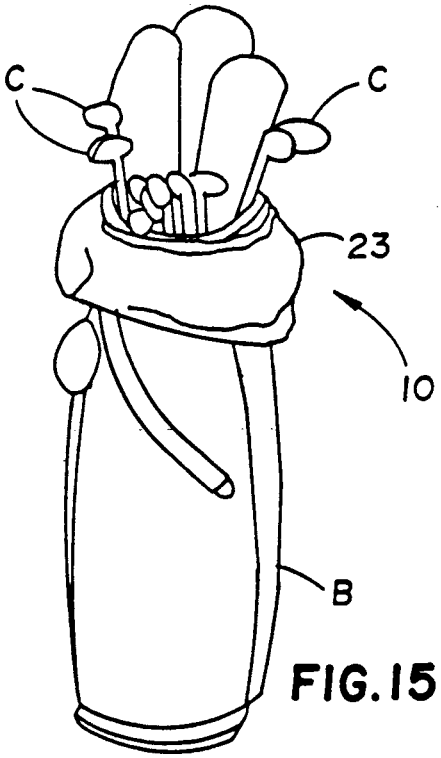
FIG. 15 is a perspective view of the present invention showing the cover rolled toward the top of the golf bag and forming a collar about the top of the bag during periods of no rain.

A further advantage of present invention is that the cover 10 is flexible and, when the first end 11 is snugged to the top of the bag B, the second end 12 may be rolled toward the top of the bag to form a collar 23 about the top of the bag B (FIG. 15). A means such as a hook or loop straps and mating hook or loop segment is provided to prevent the collar from unrolling. The cover 10 may be attached prior to use of the bag and is instantly available for use in the event of rain or inclement weather. All that is required is for the golfer to unroll the collar upwardly, away from the bag so that the second end 12 of the cover 10 protects the golf clubs C. This can be accomplished simply and provides complete protection almost immediately.

Accordingly, it will be appreciated that the present invention readily achieves its objectives. The cover 10 is compact, lightweight, completely waterproof, easy to install and easy to use. It is simply snugged to the top of the golf bag and does not rotate when so attached. The golfer has easy access to the golf clubs from the desired side of the golf bag.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A cover for the top of a golf bag, the top of the golf bag having a circumference, and for the golf clubs therein, the cover permitting access to golf clubs in the golf bag when the golf bag is carried by a player and when the golf bag is carried on a golf cart, the cover being compact, lightweight, flexible and waterproof comprising:

a sleeve having a first end and a second end, the first end having fastening means thereon such that the first end may be adjustably, snugly and non-rotatably secured at a selected one of a plurality of predetermined positions angularly spaced about the circumference of the top of the golf bag, and when so fastened, the second end of the sleeve extends outwardly from the top of the golf bag covering the golf clubs in the bag and hanging freely therefrom;

and means on the second end of the sleeve such that the second end of the sleeve may be lifted away at an angle, thereby preventing rain from entering the golf bag when the golf clubs are removed from the bag.

2. The cover of claim 1, further comprising the first end having at least one slit therein, the slit receiving therein a ring attached on the golf bag near the top of the golf bag, thereby preventing rotation of the cover.

3. The cover of claim 1, wherein the fastening means on first end of the cover comprises an adjustable first fastening means and a second fastening means thereon, the second fastening means cooperating with the first fastening means such that the first end of the cover may be secured about the top of the golf bag.

4. The cover of claim 1, wherein the cover has a sidewall, the sidewall having a panel opening therein extending from the second end towards the first end to provide access to the golf clubs within the golf bag when the second end of the cover is lifted.

5. The rain cover of claim 4, wherein the cover, when folded, is approximately five inches by five inches by one inch and may be easily stored on the golf bag.

6. The rain cover of claim 1, wherein, when the first end of the cover is snugged to the top of the golf bag, the second end of the cover may be rolled toward the top of the golf bag to form a collar about the top of the golf bag, said collar being easily and rapidly unrolled to protect the top of the golf bag and the golf clubs from rain.

7. The cover of claim 1, further comprising the first end of the bag having a plurality of spaced apart slits therein such that a ring attached on the golf bag near the top of the golf bag may be inserted into a desired slit and the cover may be adjusted to a selected position with respect to the circumference of the top of the golf bag.

8. The cover of claim 7, wherein the first end of the bag has three slits thereon.

9. The cover of claim 1, wherein the cover is fabricated from a multilayer material having an outer layer, a center layer and an inner layer.

10. The cover of claim 9, wherein the center layer is a microporous polymeric film of polytetrafluoroethylene.

11. The cover of claim 9, wherein the inner layer has a reflectorized surface to improve visibility when the second end of the cover is lifted for access to the golf clubs.

12. The cover of claim 9, wherein the inner layer has a white surface to improve visibility when the second end of the cover is lifted for access to the golf clubs.

13. A rain cover for the top of a golf bag and for the golf clubs therein, the rain cover being compact, lightweight, flexible and waterproof, comprising:

a sleeve having a first open end, a second open end and a sidewall therebetween;

the first open end having at least one slit therein, the slit receiving therein a ring which is attached near the top of the golf bag such that the ring may be inserted through the slit and a carrying strap on the golf bag may be connected to the ring thereby retaining the cover on the golf bag and preventing rotation of the cover about the top of the golf bag;

the first open end having a releasable fastening means attached thereto, the first open end further having a strap attached thereto, the strap having thereon a fastening means which cooperates with the releasable fastening means such that when the respective fastening means are engaged, the first end of the cover may be securely snugged to conform to the top of the golf bag, and when so secured the second end of the cover is disposed outwardly from the top of the golf bag and is draped over the top of the golf bag and the golf clubs therein; the cover hanging freely therefrom;

a panel opening in the side wall of the cover, the opening extending from the second end toward the first end of the cover such that when the second end is draped over the top of the golf bag, the second end may be lifted to provide ease of access to the golf clubs while providing cover to the top of the golf bag; and a releasable first fastening means attached to the second end of the cover, a cooperating second fastening means attached to the first end of the cover near the panel opening such that when the second end of the cover is folded toward the first end of the cover over the top of the golf bag and the respective first and second fastening means are engaged, the top of the golf bag and the golf clubs thereon are protected from rain and wind-driven rain and further, when the first and second fastening means are disengaged, the second end may be lifted providing access to the golf clubs from an angle and preventing rain from entering the golf bag;

wherein the cover is fabricated from a multilayer material;

wherein the multilayer material comprises an outer layer, a center layer which is waterproof and an inner layer; and wherein the inner layer has a reflectorized surface to improve visibility when the second end of the cover is lifted for access to the golf clubs.

14. The rain cover of claim 13, wherein the inner layer has a white surface to improve visibility when the second end of the cover is lifted for access to the golf clubs.

15. The rain cover of claim 13, wherein the center layer is a microporous polymeric film of polytetrafluoroethylene.

16. The rain cover of claim 13, wherein the rain cover is fabricated of a completely waterproof material.

17. The rain cover of claim 13, wherein the releasable fastening means attached to the first end of the cover is a hook or loop fastener and the cooperating fastening means on the strap is a hook or loop fastener.

18. The rain cover of claim 13, wherein the releasable first fastening means attached to the second end of the cover is a hook or loop fastener and the cooperating second fastener means attached to the first end of the cover near the panel opening is a hook or loop fastener.

19. A rain cover for the top of a golf bag and for the golf clubs therein, the rain cover being compact, lightweight, flexible and waterproof, comprising:

a sleeve having a first open end, a second open end and a sidewall therebetween;

the first open end having at least one slit therein, the slit receiving therein a ring which is attached near the top of the golf bag such that the ring may be inserted through the slit and a carrying strap on the golf bag may be connected to the ring thereby retaining the cover on the golf bag and preventing rotation of the cover about the top of the golf bag;

the first open end having a releasable fastening means attached thereto, the first open end further having a strap attached thereto, the strap having thereon a fastening means which cooperates with the releasable fastening means such that when the respective fastening means are engaged, the first end of the cover may be securely snugged to conform to the top of the golf bag, and when so secured the second end of the cover is disposed outwardly from the top of the golf bag and is draped over the top of the golf bag and the golf clubs therein; the cover hanging freely therefrom;

a panel opening in the side wall of the cover, the opening extending from the second end toward the first end of the cover such that when the second end is draped over the top of the golf bag, the second end may be lifted to provide ease of access to the golf clubs while providing cover to the top of the golf bag; and a releasable first fastening means attached to the second end of the cover, a cooperating second fastening means attached to the first end of the cover near the panel opening such that when the second end of the cover is folded toward the first end of the cover over the top of the golf bag and the respective first and second fastening means are engaged, the top of the golf bag and the golf clubs thereon are protected from rain and wind-driven rain and further, when the first and second fastening means are disengaged, the second end may be lifted providing access to the golf clubs from an angle and preventing rain from entering the golf bag;

further comprising the first end having a plurality of spaced apart slits therein such that the ring on golf bag may be inserted through a desired slit and the cover may be circumferentially disposed at a desired position with respect to the top of the golf bag, permitting access to the golf clubs from the desired position when the second end of the cover is lifted.

20. A rain cover for the top of a golf bag and for the golf clubs therein, the rain cover being compact, lightweight, flexible and waterproof, comprising:

a tubular sleeve having a first open end, a second open end and a sidewall therebetween;

the first open end having a slit therein, the slit receiving therein a ring which is attached near the top of the golf bag such that the ring may be inserted through the slit and a carrying strap on the golf bag may be connected to the ring thereby retaining the cover on the golf bag and preventing rotation of the cover about the top of the golf bag, the first open end having a releasable fastening means attached thereto, the first open end further having a strap attached thereto, the strap having thereon a fastening means which cooperates with the releasable fastening means such that when the respective fastening means are engaged, the first end of the cover may be securely snugged to conform to the top of the golf bag, and when so secured, the second end of the cover is disposed outwardly from the top of the golf bag and is draped over the top of the golf bag and the golf clubs therein, the cover hanging freely therefrom;

a panel opening in the side wall of the cover, the opening extending from the second end toward the first end of the cover such that when draped over the top of the golf bag, the second end may be lifted to provide ease of access to the golf clubs while providing cover to the top of the golf bag, a releasable first fastening means attached to the second end of the cover, a cooperating second fastening means attached to the first end of the cover near the panel opening such that when the second end of the cover is folded toward the first end of the cover over the top of the golf bag and the respective first and second fastening means are engaged, the top of the golf bag and the golf clubs therein are protected from rain and wind-driven rain and further when the first and second fastening means are disengaged, the second end may be lifted providing access to the golf club from an angle preventing rain entering the golf bag; wherein the cover is fabricated from a multilayer material, an outer layer which is durable and scuff resistant, a center layer which is waterproof and an inner layer having a reflectorized surface to improve visibility when the second end of the cover is lifted for access to the golf clubs; the releasable fastening means attached to the first end of the cover being a hook or loop fastener and the cooperating fastening means on the strap being a hook or loop fastener; releasable first fastening means attached to the second end of the cover using a hook or loop fastener and the cooperating second fastener means attached to the first end of the cover means the panel opening being a hook or loop fastener; and wherein when the first end of the cover is snugged to the top of the golf bag, the cover may be rolled toward the top of the golf bag to form a collar about the top of the golf bag, said collar being easily and rapidly unrolled to protect the top of the golf bag and the golf clubs from rain.

21. A rain cover for the top of a golf bag and for the golf clubs therein, the rain cover being compact, lightweight, flexible and waterproof, comprising:

a tubular sleeve having a first open end, a second open end and a sidewall therebetween;

the first open end having a slit therein, the slit receiving therein a ring which is attached near the top of the golf bag such that the ring may be inserted through the slit and a carrying strap on the golf bag may be connected to the ring thereby retaining the cover on the golf bag, and preventing rotation of the cover about the top of the golf bag;

the first open end having a releasable fastening means attached thereto, the first open end further having a strap attached thereto, the strap having thereon a fastening means which cooperates with the releasable fastening means such that when the respective fastening means are engaged, the first end of cover may be securely snugged to conform to the top of the golf bag, and when so secured, the second end of the cover is disposed outwardly from the top of the golf bag and is draped over the top of the golf bag and the golf clubs therein, the cover hanging freely therefrom; and a releasable first fastening means attached to the second end of the cover, a cooperating second fastening means attached to the first end of the cover such that when the second end of the cover is folded toward the first end of the cover over the top of the golf bag and the respective first and second fastening means are engaged, the top of the golf bag and the golf clubs therein are protected from rain and further when the first and second fastening means are disengaged, the second end may be lifted providing access to the golf clubs from an angle and preventing rain from entering the golf bag.

wherein the cover is fabricated from a multilayer material, an outer layer which is durable and scuff resistant, a center layer which is waterproof and an inner layer; and wherein the inner layer has a reflectorized surface to improve visibility when the second end of the cover is lifted for access to the golf clubs.

22. A rain cover for the top of a golf bag and for the golf clubs therein, the rain cover being compact, lightweight, flexible and waterproof, comprising:

a tubular sleeve having a first open end, a second open end and a sidewall therebetween;

the first open end having a slit therein, the slit receiving therein a ring which is attached near the top of the golf bag such that the ring may be inserted through the slit and a carrying strap on the golf bag may be connected to the ring thereby retaining the cover on the golf bag, and preventing rotation of the cover about the top of the golf bag;

the first open end having a releasable fastening means attached thereto, the first open end further having a strap attached thereto, the strap having thereon a fastening means which cooperates with the releasable fastening means such that when the respective fastening means are engaged, the first end of cover may be securely snugged to confirm to the top of the golf bag, and when so secured, the second end of the cover is disposed outwardly from the top of the golf bag and is draped over the top of the golf bag and the golf clubs therein, the cover hanging freely therefrom; and a releasable first fastening means attached to the second end of the cover, a cooperating second fastening means attached to the first end of the cover such that when the second end of the cover is folded toward the first end of the cover over the top of the golf bag and the respective first and second fastening means are engaged, the top of the golf bag and the golf clubs therein are protected from rain and further when the first and second fastening means are disengaged, the second end may be lifted providing access to the golf clubs from an angle and preventing rain from entering the golf bag.

wherein the cover is fabricated from a multilayer material, an outer layer which is durable and scuff resistant, a center layer which is waterproof and an inner layer; and wherein the inner layer has a white surface to improve visibility when the second end of the cover is lifted for access to the golf clubs.

23. A rain cover for the top of a golf bag and for the golf clubs therein, the rain cover being compact, lightweight, flexible and waterproof, comprising:

a tubular sleeve having a first open end, a second open end and a sidewall therebetween;

the first open end having a slit therein, the slit receiving therein a ring which is attached near the top of the golf bag such that the ring may be inserted through the slit and a carrying strap on the golf bag may be connected to the ring thereby retaining the cover on the golf bag, and preventing rotation of the cover about the top of the golf bag;

the first open end having a releasable fastening means attached thereto, the first open end further having a strap attached thereto, the strap having thereon a fastening means which cooperates with the releasable fastening means such that when the respective fastening means are engaged, the first end of cover may be securely snugged to conform to the top of the golf bag, and when so secured, the second end of the cover is disposed outwardly from the top of the golf bag and is draped over the top of the golf bag and the golf clubs therein, the cover hanging freely therefrom; and a releasable first fastening means attached to the second end of the cover, a cooperating second fastening means attached to the first end of the cover such that when the second end of the cover is folded toward the first end of the cover over the top of the golf bag and the respective first and second fastening means are engaged, the top of the golf bag and the golf clubs therein are protected from rain and further when the first and second fastening means are disengaged, the second end may be lifted providing access to the golf clubs from an angle and preventing rain from entering the golf bag; and further comprising the first end having a plurality of spaced apart slits therein such that the ring of golf bag may be inserted through a desired slit and the cover may be circumferentially disposed at the desired position with respect to the top of the golf bag, permitting access to the golf clubs from the desired position when the second end of the cover is lifted.

24. The rain cover of claim 23, wherein the releasable fastening means attached to the first end of the cover is a hook or loop fastener and the cooperating fastening means on the strap is a hook or loop fastener.

25. The rain cover of claim 23, wherein the releasable first fastening means attached to the second end of the cover is a hook or loop fastener and the cooperating second fastener means attached to the first end of the cover is a hook or loop fastener.

26. The rain cover of claim 23, wherein when the first end of the cover is snugged to the top of the golf bag, the cover may be rolled toward the top of the golf bag to form a collar about the top of the golf bag, said collar being easily and rapidly unrolled to protect the top of the golf bag and the golf clubs from rain and may be rerolled forming a collar when rain has stopped.

27. A cover for the top of a golf bag and the golf clubs therein, the cover being compact, lightweight, flexible and waterproof comprising:

a sheet of material having a first end and a second end, the first end having fastening means thereon such that the first end may be adjustably, snugly and non-rotatably secured about the top of the golf bag, the second end of the sheet of material extending outwardly from the top of the golf bag covering the golf clubs in the bag and such that the second end may be lifted for access to the golf clubs;

further comprising the first end of the sheet having at least one slit therein, the slit receiving therein a ring attached on the golf bag near the top of the golf bag thereby preventing rotation of the cover about the top of the golf bag; and further comprising the first end having a plurality of spaced apart slits therein such that the ring on the golf bag may be inserted through a desired slit and the cover may be circumferentially disposed at a desired position with respect to the top of the golf bag, permitting access to the golf clubs from the desired position when the second end of the cover is lifted.

28. The cover of claim 27, wherein the sheet of material has an inside and an outside, the inside of the first end of the cover having a first fastening means attached thereto, the outside of the first end of the cover having a second fastening means attached thereto, the second fastening means cooperating with the first fastening means, such that the cover may adjustably and snugly secured about the top of the golf bag by engagement of the first fastening means and the cooperating second fastening means.

29. The cover of claim 28, wherein the fastening means is a hook or loop fastener and the cooperating fastening means is a hook or loop fastener.

30. The cover of claim 27, further comprising the first end having a further fastening means attached thereto, the second end having a further fastening means attached thereto, the further fastening means cooperating with one another such that when the second end of the sheet of material is extended to cover the top of the golf bag, the second end may be folded back to permit the further fastening means on the first end to engage the further

31. A cover for the top of a golf bag and the golf clubs therein, the cover being compact, lightweight, flexible and waterproof comprising:

a sheet of material having a first end and a second end, the first end having fastening means thereon such that the first end may be adjustably, snugly and non-rotatably secured about the top of the golf bag, the second end of the sheet of material extending outwardly from the top of the golf bag covering the golf clubs in the bag and such that the second end may be lifted for access to the golf clubs;

wherein the cover is fabricated from a multilayer material, wherein the multilayer material comprises an outer layer, a center layer and an inner layer, and wherein the inner layer has a reflectorized surface to improve visibility when the second end of the cover is lifted for access to the golf clubs.

32. The cover of claim 31, wherein the inner layer has a white surface to improve visibility when the second end of the cover is lifted for access to the golf clubs.

33. The cover of claim 31, wherein the center layer is a microporous polymeric film of polytetrafluorethylene.

34. The cover of claim 31, wherein the cover is fabricated of a completely waterproof material.

35. The rain cover of claim 31, wherein, when the first end of the cover is snugged to the top of the golf bag, the second end of the cover may be rolled toward the top of the golf bag to form a collar about the top of the golf bag, said collar being easily and rapidly unrolled to protect the top of the golf bag and the golf clubs from rain.

36. The rain cover of claim 31, wherein the cover, when folded, is approximately five inches by five inches by one inch and may be easily stored on the golf bag.

37. A cover for the top of a golf bag, the top of the golf bag having a circumference, and for the golf clubs therein, the cover permitting access to golf clubs in the golf bag when the golf bag is carried by a player and when the golf bag is carried on a golf cart, the cover being compact, lightweight, flexible and waterproof comprising:

a sheet of material having a first end and a second end, the first end having fastening means thereon such that the first end may be adjustably, snugly and non-rotatably secured at a selected one of a plurality of predetermined positions angularly spaced about the circumference of the top of the golf bag, and when so fastened, the second end of the sheet extends outwardly from the top of the golf bag covering the golf clubs in the bag and hanging freely therefrom;

and means on the second end of the sheet such that the second end of the sheet may be lifted away at an angle, thereby preventing rain from entering the golf bag when the golf clubs are removed from the bag.

* * * * *

UNITED STATES PATENT AND TRADEMARK OFFICE

CERTIFICATE OF CORRECTION

PATENT NO. : 5,005,623

DATED : April 9, 1991

INVENTOR(S) : Webster, Jr.

It is certified that error appears in the above-identified patent and that said Letters Patent is hereby corrected as shown below:

In claim 30, column 13, line 43 of the patent, after "further", insert therein -- fastening means on the second end whereby the top of the golf bag is covered and protected from rain and the second end of the cover is prevented from being blown about by wind. -- .

Signed and Sealed this

Twenty-fifth Day of May, 1993

Michael K. Kirk

*Attest:*

MICHAEL K. KIRK

*Attesting Officer*

*Acting Commissioner of Patents and Trademarks*